US009513062B2

(12) United States Patent
Gehling et al.

(10) Patent No.: US 9,513,062 B2
(45) Date of Patent: Dec. 6, 2016

(54) DEVICE FOR INFLUENCING THE FLOW IN THE AREA OF A PIPE MANIFOLD PLATE OF A TUBE BUNDLE HEAT EXCHANGER

(75) Inventors: Juergen Gehling, Stadtlohn (DE); Gottfried Kowalik, Gescher (DE); Ludger Tacke, Velen (DE); Uwe Schwenzow, Ahaus (DE); Franz Tasler, Coesfeld (DE)

(73) Assignee: GEA TDS GMBH, Sarstedt (DE)

( * ) Notice: Subject to any disclaimer, the term of this patent is extended or adjusted under 35 U.S.C. 154(b) by 928 days.

(21) Appl. No.: 13/146,552

(22) PCT Filed: Dec. 17, 2009

(86) PCT No.: PCT/EP2009/009082

§ 371 (c)(1),
(2), (4) Date: Aug. 26, 2011

(87) PCT Pub. No.: WO2010/086004

PCT Pub. Date: Aug. 5, 2010

(65) Prior Publication Data

US 2012/0138265 A1 Jun. 7, 2012

(30) Foreign Application Priority Data

Jan. 27, 2009 (DE) ..... 10 2009 006 246

(51) Int. Cl.
*F28F 9/02* (2006.01)
*F28D 7/16* (2006.01)
(Continued)

(52) U.S. Cl.
CPC ..... *F28D 7/16* (2013.01); *F28F 9/0265* (2013.01); *F28F 9/26* (2013.01); *F28D 2021/0098* (2013.01)

(58) Field of Classification Search
CPC ..... F28F 13/12; F28F 1/40; F28F 9/0265; F28F 9/026; F15D 1/04; F15D 1/02; F28D 2021/0098
(Continued)

(56) References Cited

U.S. PATENT DOCUMENTS 2,343,560 A * 3/1944 Klein et al. ..... 138/37
2,925,830 A * 2/1960 Kautrowitz ..... 138/37
(Continued)

FOREIGN PATENT DOCUMENTS

DE 94 03 913.5 U1 5/1994
DE 103 11 529 B3 9/2004
(Continued)

OTHER PUBLICATIONS

WO 2004/083761 machine translation.*
Tubular Heat Exchanger VARITUBE, Tuchenhagen GmbH, Liquid Processing Division, 632d00, aus dem Jahre 2000.

*Primary Examiner* — Len Tran
*Assistant Examiner* — Gordon Jones
(74) *Attorney, Agent, or Firm* — Vidas, Arrett & Steinkraus, P.A.

(57) ABSTRACT

A device for influencing the flow in the area of a pipe manifold plate of a tube bundle heat exchanger with an outer channel encased by an outer sheath for a heat carrier medium, with a number of inner tubes extending axially parallel to the outer sheath through the outer channel, together forming an inner channel, each supported on the end side in the pipe manifold plate, with an inlet or outlet common for all inner tubes designed in a exchanger flange and a common outlet or respectively inlet designed in a connection piece for a product with at least one displacement body. A guide ring forms radially inside with its inner contour the required and proven flow environment for the displacement body.

24 Claims, 4 Drawing Sheets

(51) Int. Cl.
*F28F 9/26* (2006.01)
*F28D 21/00* (2006.01)

(58) Field of Classification Search
USPC ..... 138/38, 40, 114, 37, 42, 109; 165/174, 165/134.1, 158, 143, 144; 239/128–139
See application file for complete search history.

(56) References Cited

U.S. PATENT DOCUMENTS

| | | | | |
|---|---|---|---|---|
| 5,425,581 | A * | 6/1995 | Palm | 366/339 |
| 6,059,026 | A * | 5/2000 | Bailly et al. | 165/174 |
| 7,762,715 | B2 * | 7/2010 | Gordon et al. | 366/176.1 |

FOREIGN PATENT DOCUMENTS

| | | | |
|---|---|---|---|
| DE | 10 2005 059 463 | A1 | 6/2007 |
| DE | 102005059463 | A1 * | 6/2007 |
| WO | 2004/051174 | A1 | 6/2004 |
| WO | 2004/083761 | A1 | 9/2004 |
| WO | WO 2004083761 | A1 * | 9/2004 |
| WO | 2007/068343 | A1 | 6/2007 |

* cited by examiner

Fig. 2
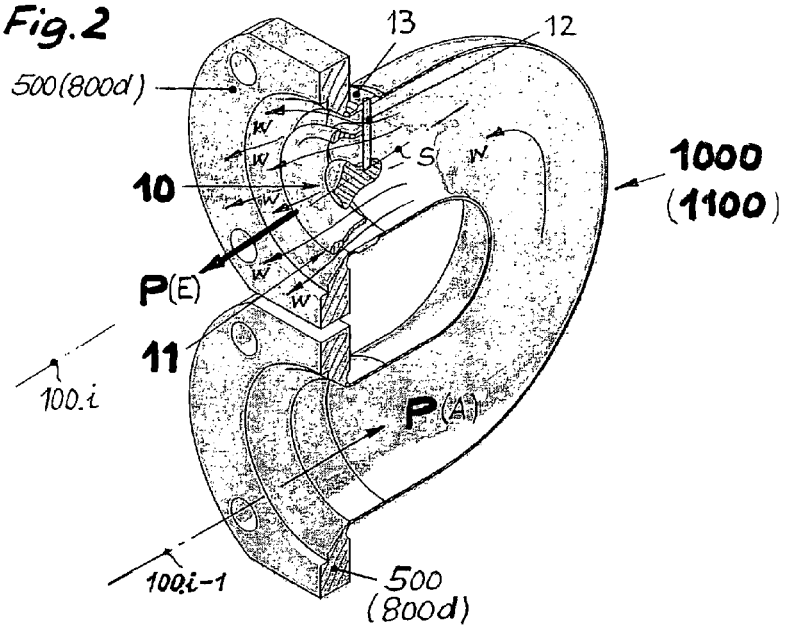
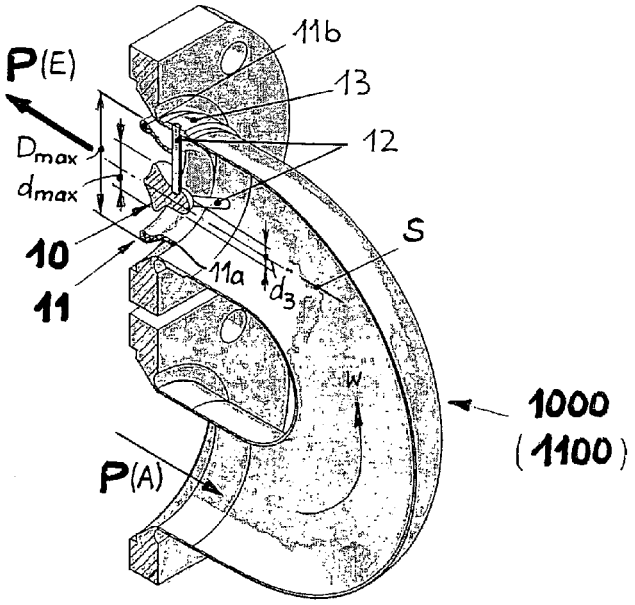
Fig. 3

DEVICE FOR INFLUENCING THE FLOW IN THE AREA OF A PIPE MANIFOLD PLATE OF A TUBE BUNDLE HEAT EXCHANGER

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The invention relates to a device for influencing the flow in the area of a pipe manifold plate of a tube bundle heat exchanger, in particular for the food and beverage industry, with an outer channel encased by an outer sheath for a heat carrier medium, with a number of inner tubes extending axially parallel to the outer sheath through the outer channel, together forming an inner channel, each supported on the end side in the pipe manifold plate, with an inlet or outlet common for all inner tubes designed in a exchanger flange and a common outlet or respectively inlet designed in a connection piece for a product with at least one displacement body influencing the flow in the inflow area of the pipe manifold plate, which is immovably fastened on a connection bend/connection armature connecting to the exchanger flange or the connection piece, arranged axially symmetrically and concentrically to the pipe manifold plate and which is made of at least two sections, which form on their connection cross-section with each other a common, largest inner outer diameter and with the displacement body, which divides the flow to the inner channel axially symmetrically, diverts it outward and thereby accelerates it in a nozzle-like narrowed annular gap cross-section, wherein the latter is formed between the displacement body and an inner contour of the exchanger flange or connection piece encasing the displacement body concentrically, and wherein the displacement body, seen in the direction of flow, subsequently forms an expanding annular gap cross-section together with the inner contour.

A device of the generic type is known from DE 10 2005 059 463 A1 B3 or WO 2007/068343 A1. The tube bundle heat exchanger in question is described in DE 94 03 913 U1. A newer state of the art in the field of the corresponding tube bundle heat exchanger, which however in principle does not differ compared to the older tube bundle heat exchanger, describes the company publication "Röhrenwärmetauscher VARITUBE®", GEA Tuchenhagen, Liquid Processing Division, 632d-00, from the year 2000.

Due to their cross-sectional geometry, such tube bundle heat exchangers are generally better than other heat exchanger designs, such as plate heat exchangers, suitable for thermal treatment of products with high and low viscosities, of solids-containing products with entire pieces, pulps or fibers. It should nonetheless be observed here that, in the case of fibrous media, such as juices with pulp, deposits form at the inlet openings of the inner tubes of the pipe manifold plates. The treatment at relatively high temperatures favors the agglomeration of fibers and the formation of pulp. It is preferably deposited on the bars between the multiple arranged inner tubes and on the surfaces of the pipe manifold plate oriented transversally to the direction of flow and there can lead to blockages. Temporary deposits are loosened from time to time and the clumps then get into the packaging of the respective product intended for the end user, where they are undesired.

The problem described above is sufficiently solved through a device suggested in DE 10 2005 059 463 A1 or WO 2007/068343 A1 for a plurality of applications; however, this device is suitable in particular for the thermal treatment of solids-containing products with entire pieces, pulp or fibers. Moreover, through the connection of the displacement body on the connection bend or the connection armature, the center of the pipe manifold plate remains free for an active center tube of the tube bundle heat exchanger if geometrically optimal tube partitions with 7, 19, 37 and more inner tubes, which all have an active center tube, are desired. It has been shown that with the known device in the case of pipe manifold plates with more than 19 tubes an uneven distribution of the flow and thus an unevenly distributed inflow of the inner tubes arranged distributed over the inflow surface of the pipe manifold plate cannot be prevented.

A device for influencing the inflow area of a pipe manifold plate of a tube bundle heat exchanger of the type being discussed is known from DE 103 11 529 B3 or WO 2004/083761 A1, in which the displacement body is either permanently connected with the center of the pipe manifold plate or is designed as a ball and is positioned articulated mainly in the center of the pipe manifold plate. In the case of this known device in both basic embodiments, geometrically optimal tube distributions with an active center tube must be foregone from the outset and an uneven distribution of the flow and thus an unevenly distributed inflow of the inner tubes arranged distributed over the inflow surface of the pipe manifold plate can also not be prevented here in the case of pipe manifold plates with more than 19 tubes.

BRIEF SUMMARY OF THE INVENTION

The object of the present invention, while avoiding problematic solutions from a hygienic, cleaning and physical flow perspective, is to further develop a device of the generic type such that an even distribution of the flow and thus an evenly distributed inflow of the inner tubes arranged distributed over the inflow surface of the pipe manifold plate is ensured in the case of pipe manifold plates with 19 and more inner tubes.

The inventive basic idea is to solve the problem of the even distribution of the inflow in this area in the case of pipe manifold plates with a large radial extension such that the generally known, desired mechanical-flow effects of the displacement body with respect to its environment are also generated by an additional component, a guide ring. The guide ring thereby forms radially inside with its inner contour the required and proven flow environment for the displacement body and it creates with its outer contour in interaction with the environment enclosing it radially outward flow-mechanically comparable and desirable conditions as they exist between the displacement body and its environment.

This succeeds according to the invention in that the inner contour known from the state of the art and corresponding with the displacement body through the inside of a rotationally symmetrical, sleeve-like guide ring in the form of an inner inner contour, in that the guide ring is permanently connected directly or indirectly with the connection bend or the connection armature and in that the guide ring is thereby formed from an inflow and outflow section, which form on their connection cross-section with each other a common, large outer outer diameter. This arrangement and design causes the guide ring to divide axially symmetrically the flow to the inner channel of the tube bundle heat exchanger, diverted to the outside, in that a radial flow component is also generated and thereby accelerated in a nozzle-like narrowed outer annular gap cross-section between the guide ring and an outer inner contour of the exchanger flange or connection piece. Connecting to the nozzle-like narrowed outer annular gap cross-section, the guide ring, seen in the direction of flow, together with the outer inner contour forms a widening outer annular gap cross-section.

The device according to the invention is preferably used on the inflow side of the pipe manifold plate so that here the discussed deposits are effectively prevented. The displacement body and the guide ring are thereby arranged wither in a connection bend designed as a 180-degree tube bend or in a connection armature causing a 180-degree flow deviation, wherein they each end on the end side in an exchanger flange or a connection piece. The connection bend or the connection armature each interconnect two neighboring, mainly parallel arranged, series-connected tube bundles of the tube bundle heat exchanger. A respective tube bundle heat exchanger is known for example from DE 94 03 913 U1. A connection bend used therein is disclosed for example in WO 2004/051 174 A1 or WO 2004/083 761 A1 and a respective connection armature is described in DE 10 2005 059 463 A1.

The sought flow mechanical effect of the guide ring comes among other things from the annular gap cross-section between the last and the outer inner contour of the exchange flange or the connection piece. The guide ring influences the flow surrounding it especially effectively when, as provided in two suggestions, a first expanded passage cross-section within the exchange flange or a second expanded passage cross-section within the connection piece is each part of the outer inner contour.

The desirable displacement of the flow is caused according to the advantageous design through a circumferential inner flow tearoff edge designed on the displacement body. This inner flow tearoff edge is especially effective when it, as is also provided, is positioned in an expanding inner annular gap cross-section of the guide ring.

The flow mechanical function of the provided displacement body comes to bear particularly advantageously when, as provided by another advantageous embodiment, the inner flow tearoff edge is positioned at the narrowest point (minimal inner annular gap cross-section) of the inner annular gap cross-section.

Another respective embodiment provides to position the inner flow tearoff edge, seen in the direction of flow, behind the narrowest point (minimal inner annular gap cross-section) of the inner annular gap cross-section.

The requirements for the displacement body do not only consist in the fact that it exerts a particularly effective influence on the flow influencable by it in the area of the pipe manifold plate, but it is also designed to cause the least possible pressure losses and to itself not become a problem for deposits. An advantageous embodiment provides in this respect that the at least two sections of the displacement body are designed axially symmetrically and form on the connection cross-section with each other, the common largest inner outer diameter, the inner flow tearoff edge.

In this connection, it is advantageous from a flow mechanical point of view if the two sections, the inflowed and the outflowed section, are each bordered by a concave outer contour. The fastening of the displacement body on the connection bend or the connection armature is aided mechanically and flow-mechanically if, as is provided, the inflowed section of the displacement body is provided with a shaft part extending in the direction of its axis of symmetry, with which the fastening traverse(s) engage.

The flow resistance of the displacement body is kept small when the first concave outer contour assigned to the inflowed section on the inflow side is rounded by a first convex outer contour.

It is also provided that the concave outer contours are rounded with each other by a second convex outer contour. This constant transition between the two concave outer contours counteracts a product crust formation in this area without this rounding forfeiting the desirable formation of the inner flow tearoff edge to be provided in this area.

In order to also counteract a product crust formation in this outflow area of the displacement body, it is furthermore suggested that the second concave outer contour assigned to the outflowed sections on the outflow side is rounded by a third convex outer contour.

The desirable displacement of the flow on the guide ring is caused according to an advantageous embodiment by a circumferential outer flow tearoff edge designed on it. The latter is then especially effective when it, as is also provided, is positioned in the expanding outer annular gap cross-section of the exchanger flange or connection piece.

The flow mechanical function of the suggested guide ring is brought to bear particularly advantageously when, as provided in another advantageous embodiment, the outer flow tearoff edge is positioned at the narrowest point (minimal outer annular gap cross-section) of the outer annular gap cross-section.

Another respective embodiment provides that the outer flow tearoff edge, seen in the direction of flow, is to be positioned behind the narrowest point (minimal outer annular gap cross-section) of the outer annular gap cross-section.

The requirements for the guide ring do not only consist in the fact that it exerts a particularly effective influence on the flow influencable by it in the area of the pipe manifold plate, but it is also designed to cause the least possible pressure losses and to itself not become a problem for deposits. An advantageous embodiment provides in this respect that the inflow and the outflow section of the guide ring are designed axially symmetrically and form the outer flow tearoff edge with each other, the common largest outer outer diameter.

The flow resistance of the guide ring is kept small when the free end of its inflow section is designed convexly rounded. A respective rounding also counteracts a product crust formation in the inflow area of the guide ring. A product crust formation in the outflow area of the guide ring is counteracted when the free end of the outflow section of the guide ring is designed convexly rounded.

The immovable fastening of the displacement body and the guide ring is designed very simply when they are connected with the connection bend or the connection armature via at least one rod-like fastening traverse engaging with both at the same time. Sufficient stability of the fastening and a symmetrical influencing of the flow by the fastening are ensured when three fastening traverses arranged distributed over the perimeter of the displacement body and thus also the guide ring are provided.

A smallest possible influencing of the flow by the fastening traverse(s) results in the inflow area of the guide ring when it/they engage/s on the free end of the inflow section of the guide ring. A smallest possible influencing of the flow by the fastening traverse(s) results in the inflow area of the displacement body when they engage on the inflowed section of the displacement body. A small flow resistant of the fastening is achieved and a product crust formation by the fastening is counteracted when, as is further provided, the inflowed section of the displacement body is provided with a shaft part extending in the direction of its axis of symmetry, with which the fastening traverse(s) engage.

In order to increase the stability of the fastening, another suggestion provides that the connection bend or the connection armature in the fastening area of the fastening traverse(s) is designed with a reinforced wall thickness in the form of a circumferential reinforcing ring.

A more detailed representation results from the following description and the accompanying figures of the drawing as well as the claims. While the invention is realized in the different embodiments, the drawing shows one exemplary embodiment of a preferred embodiment of the suggested device and the structure and function are subsequently described.

BRIEF DESCRIPTION OF THE SEVERAL VIEWS OF THE DRAWINGS

Starting from the state of the art.

Figure 1:
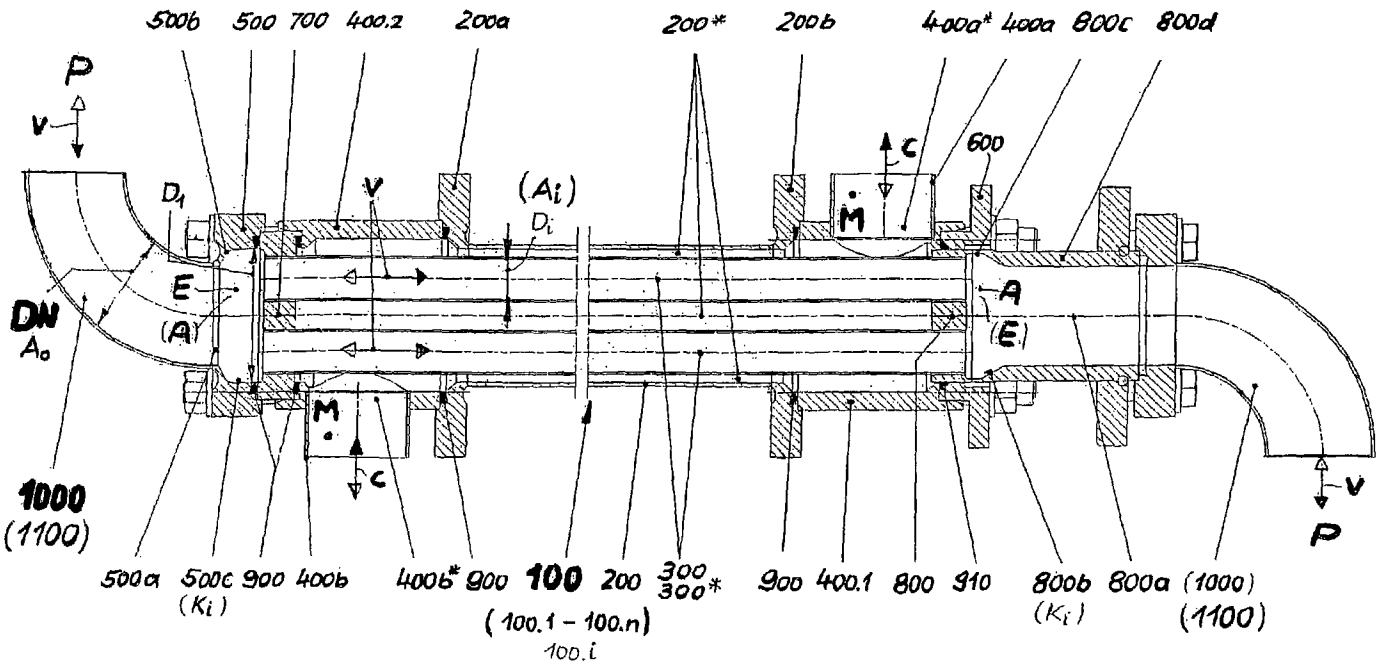
FIG. 1 shows a center cut through a so-called tube bundle as a modular part of a tube bundle heat exchanger consisting if applicable of a plurality of such tube bundles, wherein a circular connection bend or a connection armature with a 180-degree deviation as per DE 10 2005 059 463 A1 is arranged on each side, on which the characteristics according to the invention are used.

An exemplary embodiment of the suggested device according to the invention is shown in the other figures of the drawing and is described below.

Figure 4:
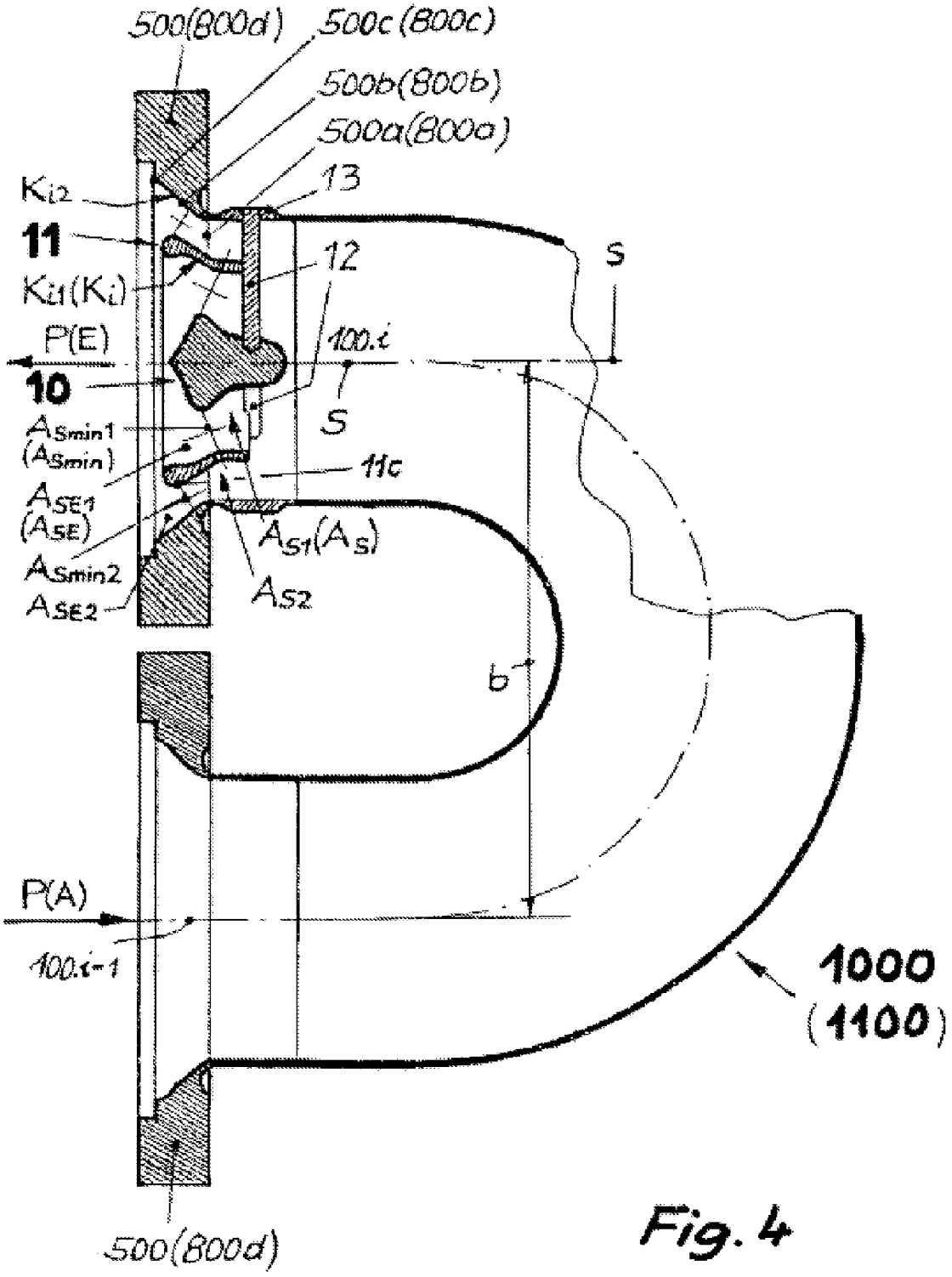
Figure 4A:
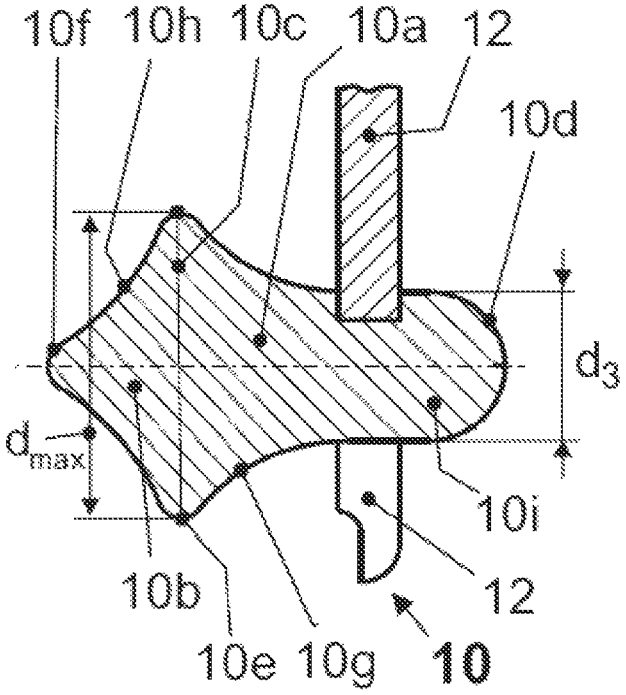

FIG. 2 shows in perspective representation a center cut through a connection bend, wherein, in it, a displacement body enclosed by a guide ring is arranged on the inflow side of a pipe manifold plate (not shown) and the view is directed at the front side of the exchanger flange and thus at the outflow side of the displacement body and the guide ring;

FIG. 3 shows in perspective representation the center cut through the connection bend as per FIG. 2, wherein the view is now directed at the inflow side of the displacement body and the guide ring;

FIG. 4 shows the center cut through the connection bend as per FIGS. 2 and 3 and FIG. 4*a* shows a center cut through the detached displacement body separated from FIG. 4.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated A tube bundle heat exchanger 100 made up as a rule of a plurality of tube bundles 100.1 through 100.*n* according to the state of the art, wherein 100.*i* describes any tube bundle (FIG. 1; also see DE 94 03 913 U1), consists in its center part of an outer sheath 200 bordering an outer channel 200* with a, in relation to the representation position, fixed bearing side outer sheath flange 200*a* arranged on the left side and a movable bearing side outer sheath flange 200*b* arranged on the right side. A first transverse channel 400*a with a first connection piece 400***a* bordered by a first housing 400.1 is connected to the latter and a second transverse channel 400*b with a second connection piece 400***b* bordered by a second housing 400.2 is connected to the fixed bearing side outer sheath flange 200*a*. A number of inner tubes 300 extending axially parallel to the outer sheath 200 through the outer channel 200* and together forming an inner channel 300*, beginning with four and then also increasing up to nineteen and, in view of the present invention, even more, are each supported on the end side in a fixed bearing side pipe manifold plate 700 or respectively a movable bearing side pipe manifold plate 800 (both also called tube reflector plate) and welded in it on their tube outer diameter, wherein this entire arrangement is inserted into the outer sheath 200 via an opening (not described in greater detail) in the second housing 400.2 and is joined together with the second housing 400.2 upon insertion of one flat seal 900 via a fixed bearing side exchanger flange 500 (fixed bearings 500, 700, 400.2).

The two housings 400.1, 400.2 are also sealed off from the respectively neighboring outer sheath flange 200*b*, 200*a* with a flat seal 900, wherein the first housing 400.1 arranged on the right side in connection with the outer sheath 200 is pressed against the fixed bearing 500, 700, 400.2 arranged on the left side via a movable bearing side exchanger flange 600 upon insertion of an O-ring 910. The movable bearing side pipe manifold plate 800 reaches through a bore hole (not described in greater detail) in the movable bearing side exchanger flange 600 and finds with respect to the latter its sealing by means of the dynamically stressed O-ring 910, which moreover seals off the first housing 400.1 statically from the movable bearing side exchanger flange 600. The latter and the movable bearing side pipe manifold plate 800 form a so-called movable bearing 600, 800, which permits the length changes of the inner tubes 300 welded in the movable bearing side pipe manifold plate 800 as a result of the temperature change in both axial directions.

Depending on the arrangement of the respective tube bundle 100.1 through 100.*n* in the tube bundle heat exchanger 100 and its respective wiring, the inner tubes 300 can, with respect to the representation position, be flowed through by a product P either from left to right or vice versa, wherein the average flow speed in the inner tube 300 and thus in the inner channel 200* is labeled with v. The cross-sectional design takes place as a rule such that this average flow speed v is also present in a connection bend 1000 or a connection armature 1100, which, relating to the tube bundle 100.*i* in question, is connected on one side with the fixed bearing side exchange flange 500 and on the other side indirectly with a movable bearing side connection piece 800*d* permanently connected with the movable bearing side pipe manifold plate 800. With the two connection bends (so-called 180-degree tube bends) each of which are only half shown in the drawing, the discussed tube bundle 100.*i* is series connected with the respectively neighboring tube bundle 100.*i*−1 or respectively 100.*i*+1. The fixed bearing side exchanger flange 500 thus once forms an inlet E for the product P and the movable bearing side connection piece 500 houses an associated outlet A; in the case of the respectively neighboring tube bundle 100.*i*−1 or respectively 100.*i*+1, these inlet and outlet relationships are accordingly reversed. An average distance from the pipe manifold plates 700, 800 bridged by the connection bend 1000 or the connection armature 1100 is labeled with b (see FIG. 4).

The fixed bearing side exchanger flange 500 has a first connection opening 500*a*, which corresponds with a nominal diameter DN and thus a nominal diameter cross-section $A_0$ of the connection bend 1000 or connection armature 1100 connected there, wherein the connection opening 500*a* should be measured as a rule such that there the flow speed corresponding to the average flow speed v in the inner tube 300 or respectively inner channel 300* is present. In the same manner, a second connection opening 800*a* is also measured in the movable bearing side connection piece 800*d*, wherein the respective connection opening 500*a* or respectively 800*a* expands to a respectively expanded passage cross-section 500*c* or respectively 800*c* in the area of the neighboring pipe manifold plate 700 or respectively 800 through a conical transition 500*b* or respectively 800*b*. The expanded passage cross-section 500*c* or respectively 800*c* is thereby designed mainly cylindrically with a diameter $D_1$ (largest diameter of the first expanded passage cross-section 500*c*), wherein the latter is dimensioned as a rule one or two nominal widths greater than the nominal diameter DN of the connection bend 1000 or the connection armature 1100 (nominal passage cross-section $A_0$ of the connection bend or connection armature) and accordingly greater than the total passage cross-section $nA_i$ of all inner tubes 300 entering the fixed bearing side exchange flange 500 of the number n with a respective tube inner diameter $D_i$ and a passage cross-section $A_i$. The expanded passage cross-section 500*c* or respectively 800*c* forms an inner contour $K_i$ in the fixed bearing side exchanger flange 500 or respectively in the movable bearing side connection piece 800*d* together with the first conical transition 500*b* or respectively 800*b*.

Depending on the direction of the flow speed v in the inner tube 300 or respectively inner channel 300*, the product P to be treated flows either over the first connection opening 500*a* or the second connection opening 800*a* to the tube bundle 100.1 through 100.*n* so that either the fixed bearing side pipe manifold plate 700 or the movable bearing side pipe manifold plate 800 are flowed into. Since in each case a heat exchange must take place between product P in the inner tubes 300 or respectively the inner channels 300* and a heat carrier medium M in the outer sheath 200 or respectively in the outer channels 200* in the counter flow, this heat carrier medium M flows either to the first connection piece 400*a* or to the second connection piece 400*b* with a flow speed in the outer sheath c.

A generally known displacement body 10 (FIG. 4*a*; e.g. state of the art as per DE 10 2005 059 463 A1) is designed overall rotationally symmetrical to its longitudinal axis, an axis of symmetry S, and consists of a preferably cylindrical shaft part $\mathbf{10}_i$, which has a shaft diameter $d_3$, and a directly connecting inflowed section 10*a*, wherein the transition between both proceeds constantly. The inflowed section 10*a* is connected with an outflowed section 10*b* away from the shaft and both sections 10*a*, 10*b* form with each other a common, largest inner outer diameter $d_{max}$ on their connection cross-section, which can simultaneously also be a circumferential inner flow tearoff edge 10*c*.

The displacement body 10 is arranged in the exchanger flange 500 or the connection piece 800*d* of the connection bend 1000 or respectively the connection armature 1100 (FIGS. 2 through 4) such that its axis of symmetry S progresses concentrically to the longitudinal axis of the tube bundle 100.*i* and thus concentrically to the pipe manifold plate 700, 800 (also see FIG. 1). The shaft part 10*i* is permanently connected with the connection bend 1000 or the connection armature 1100. The generally known arrangement described above, inasmuch as it alone concerns the displacement body 10, thus realizes a displacement body 10 positioned on the inflow side of the pipe manifold plate 700, 800.

The solution according to the invention consists in that (FIGS. 2 through 4, 4*a*) the generally known displacement body 10, the main points of which are described above, is arranged in a rotationally symmetrical, sleeve-like guide ring 11 such that the axis of symmetry S of the displacement body 10 and that of the guide ring 11 are congruent. The latter is at least formed from an inflow section 11*a* and an outflow section 11*b*, which are designed axially symmetrically and which form with each other a common, largest outer outer diameter $D_{max}$ on their connection cross-section (FIG. 3), which can simultaneously also be a circumferential outer flow tearoff edge 11*c*. The respective free end of the inflow section 11*a* and the outflow section 11*b* are preferably designed convexly rounded.

The guide ring 11 is permanently connected directly or indirectly with the connection bend 1000 or the connection armature 1100. In the exemplary embodiment shown, the displacement body 10 and the guide ring 11 surrounding it concentrically are permanently connected via three rod-like fastening traverses 12 arranged distributed evenly over the perimeter of the displacement body 10 and thus also the guide ring 11 (FIG. 3), wherein the fastening traverses 12 engage on the free end of the inflow section 11*a* and simultaneously directly or indirectly on the inflowed section 10*a*, and here preferably on the shaft part 10*i* extending in the direction of the axis of symmetry S (FIG. 4*a*). The connection bend 1000 or the connection armature 1100 is designed in the fastening area of the fastening traverses 12 with a reinforced wall thickness in the form of a circumferential reinforcing ring 13 (FIGS. 2 through 4).

The at least two sections 10*a*, 10*b* of the displacement body 10 are each bordered by a concave outer contour 10*g*, 10*h* (FIG. 4*b*), wherein the first concave outer contour 10*g* assigned to the inflowed section 10*a* is rounded on the inflow side by a first convex outer contour 10*d*. The concave outer contours 10*g*, 10*h* are rounded with each other by a second convex outer contour 10*e*, and the second concave outer contour 10*h* assigned to the outflowed section 10*b* is rounded on the outflow side by a third convex outer contour 10*f*.

The displacement body 10 forms between its shaft part 10*i* and the adjacent inflowed section 10*a*, which is shaped with the first concave outer contour 10*g*, and the inflow section 11*a* of the guide ring 11, which forms a first section of an inner interior contour $K_{i1}$, a nozzle-like narrowing inner annular gap cross-section $A_{S1}$ (FIG. 4). At its narrowest point, the latter borders a minimal, inner annular gap cross-section $A_{Smin1}$, radially inside of the inner flow tearoff edge 10*c*. The second concave outer contour 10*h* shaped on the outflowed section 10*b* of the displacement body 10, seen in the direction of flow, forms together with a second section of the inner interior contour $K_{i1}$ an expanding inner annular gap cross-section $A_{SE1}$.

The displacement body 10 in the encircling guide ring 11 forming the inner interior contour $K_{i1}$ divides an entering product flow P(E) flowing over the connection bend 1000 or the connection armature 1100 with an unevenly distributed flow speed w to the inner channel 300*(see FIG. 1) of the tube bundle 100.*i* through the annular gap cross-sections $A_{S1}$, $A_{Smin1}$ and $A_{SE1}$ axially symmetrically over the entire perimeter of the annular gap cross-section 10*a* and diverts it outward (FIGS. 2, 4). The product flow P(E) entering the tube bundle 100.*i* results from an exiting product flow P(A), which flows out of the upstream tube bundle 100.*i*−1 via the connection bend 1000 or the connection armature 1100. The flow is thereby accelerated in the inner annular gap cross-section $A_{S1}$ narrowed in a nozzle-like manner between the displacement body 10 and the inner interior contour $K_{i1}$ of the guide ring 11 and achieves at its narrowest point, the minimal inner annular gap cross-section $A_{Smin1}$, a maximum flow speed. The inner flow tearoff edge 10*c* is positioned in the exemplary embodiment at the point of the minimum inner annular gap cross-section $A_{Smin1}$.

The flow is diverted behind the displacement body 10 to the center of the pipe manifold plate 700, 800, whereby the most even possible flow through all inner tubes 300 or respectively inner channels 300* takes place in this central area (also see FIG. 1). Moreover, the passage cross-section for the flow extends behind the minimal inner annular gap cross-section $A_{Smin1}$. The thus bent and delayed flow must inevitably release in this area. Through the inner flow tearoff edge 10*c*, the release takes place according to plan at this clearly defined point. The described flow movement behind the displacement body 10 leads there to a secondary flow according to the mechanical flow laws, on which the desired effect, namely the prevention of deposits in the central area of the inflowed pipe manifold plate 700, 800, is partially based.

The flow relationships in the annular gap cross-sections $A_{S1}$, $A_{Smin1}$ and $A_{SE1}$ are, inasmuch as they are limited to an arrangement of the displacement body 10 as per DE 10 2005 059 463 A1, are known in principle; they are labeled there and also additionally in FIG. 4 of the present invention—in the latter due to the assignment to the known state of the art—with $A_S$, $A_{Smin}$ and $A_{SE}$.

The guide ring 11 forms between its inflow section 11*a* and a first section of an outer inner contour $K_{i2}$ which is mainly formed by the first conical transition 500*b* in the exchanger flange 500 and the superordinate tube part surrounding the first connection opening 500*a* or by the second conical transition 800*b* in the connection piece 800*d* and the superordinate tube part surrounding the second connection opening 800*a*, a nozzle-like narrowing outer annular gap cross-section $A_{S2}$ (FIG. 4). The outer annular gap cross-section $A_{S2}$ is bordered at it narrowest point, a minimum outer annular gap cross-section $A_{Smin2}$, radially inside by the outer flow tearoff edge 11*c*.

The outflow section 11*b* of the guide ring 11 forms, seen in the direction of flow, together with a second section of the outer inner contour $K_{i2}$, which is mainly formed by the first conical transition 500*b* in the exchanger flange 500 and the subordinate first expanded passage cross-section 500*c* or by the second conical transition 800*b* in the connection piece 800*d* and the subordinate second expanded passage cross-section 800*c*, an expanding outer annular gap cross-section $A_{SE2}$ (FIG. 4).

The guide ring 11 in the surrounding outer inner contour Kit divides the entering product flow P(E) flowing over the connection bend 1000 or the connection armature 1100 with an unevenly distributed flow speed w to the inner channel 300*(see FIG. 1) of the tube bundle 100.*i* through the annular gap cross-sections $A_{S2}$, $A_{Smin2}$ and $A_{SE2}$ axially symmetrically over the entire perimeter of the annular gap cross-sections and diverts it mainly outward (FIGS. 2, 4). The diversion of the flow into the outer area of the pipe manifold plate 700, 800 is among other things the declared goal of the invention, in particular when the pipe manifold plate 700, 800 has nineteen (n=19) inner tubes and more in number. The flow is accelerated in the outer annular gap cross-section $A_{S2}$ narrowed in a nozzle-like manner between the guide ring 11 and the outer inner contour $K_{i2}$ and achieves at its narrowest point, the minimum outer annular gap cross-section $A_{Smin2}$, a maximum flow speed. The outer flow tearoff edge 11*c* (FIG. 4) is positioned in the exemplary embodiment at the point of the minimum outer annular gap cross-section $A_{Smin2}$.

The flow is also diverted radially inward behind the guide ring 11, whereby a most even possible flow through of the inner tubes 300 or respectively inner channels 300* takes place in this central outer area, which can no longer be sufficiently influenced by the displacement body 10. Moreover, the passage cross-section for the flow expands behind the minimum outer annular gap cross-section $A_{Smin2}$. The thus bent and delayed flow must inevitably release in this area. Through the outer flow tearoff edge 11*c*, the release takes place according to plan at this clearly defined point. The described flow movement behind the guide ring 11 leads there to a secondary flow according to the mechanical flow laws, on which the desired effect, namely the prevention of deposits in the central outer area of the inflowed pipe manifold plate 700, 800, is partially based.

Through the interaction according to the invention of the displacement body 10 and the guide ring 11 (FIGS. 2 through 4), a mainly even distribution of the flow and thus a mainly evenly distributed inflow of the inner tube 300 arranged distributed over the inflow surface of the pipe manifold plate 700, 800 is ensured in the case of tube bundle heat exchangers 100 of the discussed type (FIG. 1) with pipe manifold plates 700, 800, which have in particular n=19 and more inner tubes, in a, seen in the direction of flow, distribution cross-section (flow speed w; see FIG. 3) forming behind the displacement body 10 and the guide ring 11.

This completes the description of the preferred and alternate embodiments of the invention. Those skilled in the art may recognize other equivalents to the specific embodiment described herein which equivalents are intended to be encompassed by the claims attached hereto.

REFERENCE LIST OF USED ABBREVIATIONS

FIG. 1 (State of the Art—DE 94 03 913 U1)
100 Tube bundle heat exchanger
100.1, 100.2, . . . , 100.*i*, . . . , 100.*n* Tube bundles
100.*i* i-th tube bundle
100.*i*+1 Tube bundle subordinate to tube bundle 100.*i*
100.*i*−1 Tube bundle superordinate to tube bundle 100.*i*
200 Outer sheath
200* Outer channel
200*a* Fixed bearing side outer sheath flange
200*b* Movable bearing side outer sheath flange
300 Inner tube
300* Inner channel
400.1 First housing
400*a* First connection piece
400*a** First transverse channel
400.2 Second housing
400*b* Second connection piece
400*b** Second transverse channel
500 (Fixed bearing side) exchanger flange
500*a* First connection opening
500*b* First conical transition
500*c* First expanded passage cross-section
600 Movable bearing side exchanger flange
700 Fixed bearing side pipe manifold plate (tube reflector plate)
800 Movable bearing side pipe manifold plate (tube reflector plate)
800*a* Second connection opening
800*b* Second conical transition
800*c* Second expanded passage cross-section
800*d* (Movable bearing side) connection piece
900 Flat seal
910 O-ring

1000 Connection bend
1100 Connection armature
b Average distance of the pipe manifold plate (tube bundle)
c Flow speed in the outer sheath
n Number of inner tubes
v Average flow speed in the inner tube
A Outlet
$A_i$ Passage cross-section of the inner tube
$A_0$ Total passage cross-section of all parallel flowed through inner tubes
$A_0$ Nominal passage cross-section of the connection bend
$D_i$ Tube inner diameter (inner tube 300)
$D_1$ Largest diameter of the first expanded passage cross-section 500*c* in the fixed bearing side exchanger flange 500
DN Nominal diameter of the connection bend ($A_0$=$DN^2\pi/4$)
E Inlet
$K_i$ Inner contour
M Heat carrier medium, general
P Product (temperature-treated side)
(State of the Art—DE 10 2005 059 463 A1)
(10 Displacement body)
(10*a*, 10*b*) Sections
$d_{max}$ Common, largest (inner) outer diameter (displacement body)
$d_3$ Shaft diameter
$A_S$ Annular gap cross-section
$A_{SE}$ Expanding annular gap cross-section
$A_{Smin}$ Minimal annular gap cross-section (narrowest point of the annular gap cross-section $A_S$)
S Axis of symmetry
FIGS. 2 through 4, 4*a*
10 Displacement body
10*a* Inflowed section
10*b* Outflowed section
10*c* Inner flow tearoff edge
10*d* First convex outer contour
10*e* Second convex outer contour
10*f* Third convex outer contour
10*g* First concave outer contour
10*h* Second concave outer contour
10*i* Shaft part
11 Guide ring
11*a* Inflow section
11*b* Outflow section
11*c* Outer flow tearoff edge
12 Fastening traverse
13 Reinforcing ring
w Flow speed in the distribution cross-section
$A_{S1}$ Inner annular gap cross-section
$A_{SE1}$ Expanding inner annular gap cross-section
$A_{Smin1}$ Minimal inner annular gap cross-section (narrowest point of the inner annular gap cross-section $A_{S1}$
$A_{S2}$ Outer annular gap cross-section
$A_{SE2}$ Expanding outer annular gap cross-section
$A_{Smin2}$ Minimal outer annular gap cross-section (narrowest point of the outer annular gap cross-section $A_{S2}$)
$D_{max}$ Common, largest outer exterior diameter (guide ring)
$K_{i1}$ Inner inner contour
$K_{i2}$ Outer inner contour
P(A) Exiting product flow
P(E) Entering product flow

The invention claimed is:

1. A device for influencing the flow in the area of a pipe manifold plate (700, 800) of a tube bundle heat exchanger (100), comprising:

at least one displacement body (10) influencing the flow in an inflow area of a pipe manifold plate (700, 800), wherein a tube bundle heat exchanger (100) has an outer channel (200*) encased by an outer sheath (200) for a heat carrier medium (M), a number of inner tubes (300) extending axially parallel to the outer sheath (200) through the outer channel (200*), together forming an inner channel (300*), each supported on an end side in the pipe manifold plate (700, 800), an inlet (E) or outlet (A) common for all the inner tubes (300) designed in an exchanger flange (500) and a common outlet (A) or respectively inlet (E) designed in a connection piece (800*d*) for a product (P), wherein the displacement body (10) is immovably fastened on a connection bend (1000) and or connection armature (1100) connecting to the exchanger flange (500) or the connection piece (800*d*), said pipe manifold plate not being fastened to said connection bend or connection armature arranged axially symmetrically and concentrically to the pipe manifold plate (700, 800) and formed from at least two sections (10*a*, 10*b*), which form on a connection cross-section with each other a common, largest diameter of the displacement body ($d_{max}$), wherein the displacement body (10) divides the flow to the inner channel (300*) axially symmetrically, diverts the flow outward and thereby accelerates in a nozzle-like narrowed annular gap cross-section ($A_S$), wherein the annular gap cross-section is formed between the displacement body (10) and an inner contour ($K_i$) corresponding with the exchanger flange (500) or the connection piece (800*d*) surrounding the displacement body concentrically, formed in the exchanger flange (500) or a connection piece (800*d*), and wherein the displacement body (10), seen in the direction of flow, subsequently forms an expanding annular gap cross-section ($A_{SE}$) together with the inner contour ($K_i$), wherein, a single rotationally symmetrical, guide ring (11) is arranged concentrically between the displacement body (10) and the exchanger flange (500) or the connection piece (800*d*), and the exchanger flange or the connection piece forms the inner contour with the guide ring's radial inner contour that forms a path of the flow adjacent the displacement body, said single guide ring being the only guide ring in the annular gap between the displacement body and the inner contour, the guide ring (11) is permanently connected directly or indirectly with the connection bend (1000) or the connection armature (1100), the guide ring (11) is formed between at least from an inflow section (11*a*) and an outflow section (11 *b*), and there is a common, largest diameter of the guide ring ($D_{max}$), the guide ring (11) divides the flow to the inner channel (300*) axially symmetrically, diverts the flow outward and thereby accelerates in an outer annular gap cross-section ($A_{S2}$) narrowed in a nozzle-like manner between the guide ring (11) and flange inner contour ($K_{i2}$) of the exchanger flange (500) or connection piece (800*d*), and the guide ring (11), seen in the direction of flow, subsequently forms together with the flange inner contour ($K_{i2}$) an expanding outer annular gap cross-section ($A_{SE2}$).

2. The device according to claim 1, wherein the exchanger flange (500) has a first connection opening (500*a*) on one side leading to the connection bend (1000) and or the connection armature (1100), which on the other side expands in the exchanger flange (500) through a first conical transition (500*b*) to a first expanded passage cross-section (500*c*) formed there and the first expanded passage cross-section (500*c*) within the exchanger flange (500) is part of the flange inner contour ($K_{i2}$).

3. The device according to claim 1, wherein the connection piece (800*d*) has on one side a second connection opening (800*a*) leading to the connection bend (1000) and or the connection armature (1100), which on the other side expands in the connection piece (800*d*) through a second conical transition (800*b*) to a second expanded passage cross-section (800*c*) formed at the second connection bend and the second expanded passage cross-section (800*c*) within the exchanger flange (800*d*) is part of the flange inner contour ($K_{i2}$).

4. The device according to claim 1, wherein the displacement body (10) has a circumferential inner flow tearoff edge (10*c*).

5. The device according to claim 4, wherein the inner flow tearoff edge (10*c*) is positioned adjacent to an expanded inner annular gap cross-section (ASE1).

6. The device according to claim 4, wherein the inner flow tearoff edge (10*c*) is positioned adjacent to a narrowest point of the inner annular gap cross-section (AS1), wherein said narrowest point is a minimal annular gap cross-section (ASmin1).

7. The device according to claim 4, wherein the inner flow tearoff edge (10*c*), seen in the direction of flow, is positioned behind a narrowest point of the inner annular gap cross-section (AS1) wherein said narrowest point is a minimal annular gap cross-section (ASmin1).

8. The device according to claim 4, wherein the at least two sections (10*a*, 10*b*) are designed axially symmetrically and on the connection cross-section form together, the common, largest diameter of the displacement body (dmax), the inner flow tearoff edge (10*c*).

9. The device according to claim 1, wherein the two sections (10*a*, 10*b*) are each bordered by a first and second concave outer contour (10*g*, 10*h*).

10. The device according to claim 9, wherein the first concave outer contour (10*g*) assigned to the inflowed section (10*a*) is rounded on an inflow side by a first convex outer contour (10*d*).

11. The device according to claim 9, wherein the first and second concave outer contours (10*g*, 10*h*) are rounded with each other through a second convex outer contour (10*e*).

12. The device according to claim 9, wherein the second concave outer contour (10*h*) assigned to the outflowed section (10*b*) is rounded on the outflow side by a third convex outer contour (10*f*).

13. The device according to claim 1, wherein the guide ring (11) has a circumferential outer flow tearoff edge (11*c*).

14. The device according to claim 13, wherein the outer flow tearoff edge (11*c*) is positioned in the expanding outer annular ring cross-section (ASE2).

15. The device according to claim 13, wherein the outer flow tearoff edge (11*c*) is positioned adjacent to a second narrowest point of the outer annular gap cross-section (AS2), wherein said narrowest point is a minimal outer annular gap cross-section (ASmin2).

16. The device according to claim 13, wherein the outer flow tearoff edge (11*c*), seen in the direction of flow, is positioned behind a second narrowest point of the outer annular gap cross-section (AS2), wherein said narrowest point is minimal outer annular gap cross-section (ASmin2).

17. The device according to claim 13, wherein the inflow section (11*a*) and the outflow section (11*b*) are designed axially symmetrically and form on a second connection cross-section with each other adjacent to the largest diameter of the guide ring (Dmax) and the outer flow tearoff edge (11*c*).

18. The device according to claim 1, wherein the respective free end of the inflow section (11*a*) and the outflow section (11*b*) are designed convexly rounded.

19. The device according to claim 1, wherein the displacement body (10) and the guide ring (11) are connected via at least one fastening traverse (12) with the connection bend (1000) or the connection armature (1100).

20. The device according to claim 19, wherein the at least one fastening traverses (12) are arranged evenly distributed over the perimeter of the displacement body (10) are provided.

21. The device according to claim 19, wherein the at least one fastening traverse(s) (12) engage on the free end of the inflow section (11*a*).

22. The device according to claim 19, wherein the at least one fastening traverse(s) (12) engage with the inflowed section (10*a*) directly or indirectly.

23. The device according to claim 22, wherein the inflowed section (10*a*) is provided with a shaft part (10*i*) extending in the direction of its axis of symmetry (S), with which the at least one fastening traverse(s) (12) engage.

24. The device according to claim 19, wherein the connection bend (1000) or the connection armature (1100) in the fastening area of the at least one fastening traverse(s) (12) is designed with a circumferential reinforcing ring (13).

* * * * *